US011624595B2

(12) United States Patent
Reuther et al.

(10) Patent No.: US 11,624,595 B2
(45) Date of Patent: Apr. 11, 2023

(54) SELF-GLOWING MATERIALS AND TRACER AMMUNITION

(71) Applicant: Battelle Memorial Institute, Columbus, OH (US)

(72) Inventors: James J. Reuther, Worthington, OH (US); Paul E. Shawcross, Hilliard, OH (US); Chad M. Cucksey, Worthington, OH (US); Ronald L. Loeser, Bexley, OH (US); John R. Leach, Tucson, AZ (US); Jason E. Paugh, Columbus, OH (US); Emmett Mark Tackett, West Jefferson, OH (US); James D. Gombarcik, Richwood, OH (US)

(73) Assignee: Battelle Memorial Institute, Columbus, OH (US)

( * ) Notice: Subject to any disclaimer, the term of this patent is extended or adjusted under 35 U.S.C. 154(b) by 38 days.

(21) Appl. No.: 17/393,385

(22) Filed: Aug. 3, 2021

(65) Prior Publication Data

US 2021/0364261 A1 Nov. 25, 2021

Related U.S. Application Data

(62) Division of application No. 16/740,416, filed on Jan. 11, 2020, now Pat. No. 11,105,598, which is a (Continued)

(51) Int. Cl.
*F42B 12/38* (2006.01)
*C06B 23/00* (2006.01)
(Continued)

(52) U.S. Cl.
CPC ..... *F42B 12/38* (2013.01); *C06B 23/008* (2013.01); *C06B 33/00* (2013.01); *F42B 12/382* (2013.01); *F42B 12/42* (2013.01)

(58) Field of Classification Search
USPC ..... 102/513; 149/2, 5, 108.2, 109.4
See application file for complete search history.

(56) References Cited

U.S. PATENT DOCUMENTS 1,395,567 A 11/1921 Forti
1,467,603 A 9/1923 Bisson
(Continued)

FOREIGN PATENT DOCUMENTS

CN 2132147 Y 5/1993
CN 101260295 A 9/2008
(Continued)

OTHER PUBLICATIONS

Anonymous, "Ferrocerium—Composition", www.liquisearch.com (2015).
(Continued)

*Primary Examiner* — James E McDonough
(74) *Attorney, Agent, or Firm* — Susanne A. Wilson; Frank Rosenberg

(57) ABSTRACT

A self-glowing solid material comprises a man-made metal mixture containing at least one rare earth metal and an oxide of iron. The material is inducible by flame initiation to self-glow with yellow-to-red colors (577-to-700 nanometer wavelengths). A stealth tracer ammunition comprises a projectile body having a tip and a base, and a solid pellet disposed in the base. The pellet may be made from the above-mentioned self-glowing solid material or another suitable material. The pellet becomes incandescent as a result of being heated when the ammunition is fired. The incandescent pellet emits a glow observable only from behind when the ammunition travels downrange after being fired. An illuminant comprises a bimodal blend of a man-made metal mixture containing at least one rare earth metal and an oxide of iron. The bimodal blend is a blend of smaller-sized fragments and larger-sized pellets. The illu-
(Continued)

minant is capable of ignition and dispersion in response to ballistic energy to create illumination. An illumination device comprises a body having an interior cavity, the body configured to be launched as a projectile or configured to contain projectiles. An illuminant is disposed in the cavity, the illuminant comprising a bimodal blend of a suitable illuminant material. The illuminant is capable of ignition and dispersion in response to ballistic energy to create illumination.

10 Claims, 3 Drawing Sheets

Related U.S. Application Data division of application No. 15/366,269, filed on Dec. 1, 2016, now Pat. No. 10,557,696.

(51) Int. Cl.

| | |
|---|---|
| ***F42B 12/42*** | (2006.01) |
| ***C06B 33/00*** | (2006.01) |
| *C06B 45/00* | (2006.01) |
| *C06B 45/30* | (2006.01) |
| *D03D 23/00* | (2006.01) |
| *D03D 43/00* | (2006.01) |

(56) References Cited

U.S. PATENT DOCUMENTS

| | | | |
|---|---|---|---|
| 1,564,613 | A | 12/1925 | Neviere |
| 2,062,486 | A | 4/1934 | Van Dusen, Jr. et al. |
| 2,502,533 | A | 4/1950 | Quercia et al. |
| 2,509,744 | A | 5/1950 | Quercia et al. |
| 2,611,316 | A | 9/1952 | Alexander |
| 2,638,763 | A | 5/1953 | D'Alton |
| 2,651,567 | A | 9/1953 | Clauser et al. |
| 2,760,364 | A | 8/1956 | D'Alton et al. |
| 3,052,112 | A | 9/1963 | Wheeler |
| 3,275,484 | A | 9/1966 | Foote et al. |
| 3,611,936 | A | 10/1971 | Bouisse et al. |
| 3,653,995 | A | 4/1972 | Selleck et al. |
| 3,861,311 | A | 1/1975 | Bilsbury |
| 3,948,181 | A | 4/1976 | Bergstrom |
| 3,959,041 | A | 5/1976 | Knapp |
| 3,961,554 | A | 6/1976 | Harris et al. |
| 4,096,804 | A | 6/1978 | Bilsbury |
| 4,301,732 | A | 11/1981 | Van Sickle |
| 4,351,240 | A | 9/1982 | McCubbin et al. |
| 4,508,580 | A | 4/1985 | Klober |
| 4,519,855 | A | 5/1985 | Leneveu et al. |
| 4,528,911 | A | 7/1985 | DePhillipo et al. |
| 4,625,650 | A | 12/1986 | Bilsbury |
| 4,870,884 | A | 10/1989 | Schubart et al. |
| 4,960,564 | A | 10/1990 | Sutula et al. |
| 4,970,960 | A | 11/1990 | Feldman |
| 5,020,439 | A | 6/1991 | Winter et al. |
| 5,076,169 | A | 12/1991 | Jeanquartier et al. |
| 5,096,507 | A | 3/1992 | Lohberger et al. |
| 5,121,691 | A | 6/1992 | Nicolas |
| 5,497,181 | A | 3/1996 | Paoli |
| 5,531,163 | A | 7/1996 | Dillehay et al. |
| 5,852,256 | A | 12/1998 | Hornig |
| 7,055,438 | B1 | 6/2006 | Manole et al. |
| 7,278,354 | B1 | 10/2007 | Langan et al. |
| 7,544,228 | B2 | 6/2009 | Chun et al. |
| 7,661,368 | B2 | 2/2010 | Reiss et al. |
| 7,752,976 | B2 | 7/2010 | Banks |
| 7,753,553 | B2 | 7/2010 | Justel et al. |
| 8,007,608 | B1 | 8/2011 | Herbage et al. |
| 8,186,995 | B2 | 5/2012 | Putrello, Jr. |
| 8,402,896 | B1 | 3/2013 | Hollerman et al. |
| 8,635,957 | B2 | 1/2014 | Orlev et al. |
| 8,640,621 | B2 | 2/2014 | Broden et al. |
| 8,783,186 | B2 | 7/2014 | Scanlon et al. |
| 8,813,652 | B2 | 8/2014 | Shin et al. |
| 8,919,255 | B1 | 12/2014 | Quintana et al. |
| 8,997,652 | B2 | 4/2015 | Tepera et al. |
| 9,084,455 | B2 | 7/2015 | Millan |
| 9,347,753 | B1 | 5/2016 | Horch et al. |
| 9,365,786 | B2 | 6/2016 | Anderson et al. |
| 9,377,278 | B2 | 6/2016 | Rubin |
| 9,513,094 | B2 | 12/2016 | Dierks et al. |
| 9,739,584 | B2 | 8/2017 | Chua et al. |
| 10,422,613 | B2 | 9/2019 | Reuther et al. |
| 10,557,696 | B2 | 2/2020 | Reuther et al. |
| 10,648,775 | B2 | 5/2020 | Sullivan |
| 2005/0193564 | A1 | 9/2005 | Trbovich |
| 2010/0050690 | A1 | 3/2010 | Woodward |
| 2012/0208134 | A1 | 8/2012 | Blau et al. |
| 2015/0308802 | A1* | 10/2015 | Chua ..... F42B 12/382 241/1 |
| 2016/0109127 | A1 | 4/2016 | Bolger |
| 2016/0161217 | A1 | 6/2016 | Sullivan |

FOREIGN PATENT DOCUMENTS

| | | | |
|---|---|---|---|
| CN | 102978504 | B | 7/2014 |
| CN | 103361543 | B | 7/2015 |
| DE | 1623371 | C1 | 12/1977 |
| GB | 1317031 | A | 5/1973 |
| GB | 2186061 | A | 1/1987 |
| KR | 100917149 | B1 | 9/2009 |
| WO | 1999011587 | A1 | 3/1999 |

OTHER PUBLICATIONS

Anonymous, "Ferrocerium Flint Rod/Mischmetal Flint Rod", www.alibaba com (2015).

Shanghai Jiangxi Metals, FerroCerium + Mischmetal (RE):, www.jxmetals.com (1995).

Fuller Mfg. Co., "Lighter Flints-Ferro Cerium", Materials Safety Data Sheet No. 69523-06-04, Jan. 1, 2013, US Dept. of Labor.

Oko-Institute e.V,, "Rare Earths—Facts and Figures", Oko-Institute, Berlin, Germany (2011).

Hedrick, James B., "Rare-Earth Minerals and Metals", Minerals Yearbook, pp. 705-714 (1982).

Hedrick, James B, "Rare Earths", U.S. Geological Survey Minerals Yearbook, pp. 62 10-62 17 (2000).

Hillstrom, "Impact Thresholds for the Initiation of Metal Sparking" USA Ballistic Research Laboratories Report No. ARBL-MR-02820 (1978).

Hillstrom, "Formation of Pyrophoric Fragments", USA Ballistic Research Laboratories, No. 2306 (1973).

McCann, John, "Demystified: Ferrocerium and Mischmetal Fire Starter Rods", https://gundigest.com/more/how-to/demystified-ferrocerium-mischmetal-fire-starter-rods (Aug. 2015).

Jacobson et al. (US Bureau of Mines), "Explosibility of Metal Powders", Bureau of Mines Report 6516 (1964).

Moore et al. (Los Alamos Natl Lab.) Thermite Combustion Enhancement Resulting from Bimodal Aluminum Distribution, 31st International Pyrotechnics Seminar (2004).

Machine translation, German Patent Publication 1623371, published Dec. 8, 1977.

Machine translation, Korean Patent Publication 100917149 B1, published Sep. 15, 2009.

First Office Action and Search Report of Chinese Patent Application No. 2017800846695, dated Apr. 28, 2021.

Translation of First Office Action and Search Report of Chinese Patent Application No. 201780084669.5, dated Apr. 28, 2021.

2ndOffice Action and Search Report of Chinese Patent Application No. 201780084669.5, dated Feb. 25, 2022.

Translation of 2ndOffice Action and Search Report of Chinese Patent Application No. 201780084669.5, dated Feb. 25, 2022.

Written Opinion from International Application No. PCT/US2017/064360 dated Apr. 11, 2018.

(56) References Cited

OTHER PUBLICATIONS

International Preliminary Examination Report in PCT/US2017/064360 dated Jun. 4, 2019.
International Search Report from International Application No. PCTIUS2017/064360 dated Apr. 11, 2018.
Office Action in Israelian Patent Application No. IL267032A, dated Aug. 4, 2022.

* cited by examiner

SELF-GLOWING MATERIALS AND TRACER AMMUNITION

RELATED APPLICATIONS

This application is a divisional of U.S. patent application Ser. No. 16/740,416 filed 11 Jan. 2020 which was a divisional of U.S. patent application Ser. No. 15/366,269 filed 1 Dec. 2016, now U.S. Pat. No. 10,557,696.

STATEMENT REGARDING FEDERALLY SPONSORED RESEARCH OR DEVELOPMENT

This invention was made with Government support under contract nos. CON00011161 and CON00020616 awarded by the U.S. Army Armament Research, Development and Engineering Center (ARDEC). The Government has certain rights in the invention.

BACKGROUND OF THE INVENTION

This invention relates in general to light-producing materials, and in particular to novel self-glowing solid materials and their use in novel tracer ammunition. This invention also relates in particular to novel illuminants and their use in novel illumination devices.

Tracer ammunition includes bullets and other projectiles that include a mechanism to provide a visible artifact enabling the shooter to see the path of the ammunition upon firing. Tracer ammunition may include a small pyrotechnic charge of powder filled into a cavity manufactured into the base. This charge can be ignited by the burning gun powder, and, once ignited, burns very brightly enough to be visible to the bare eye. The tracer allows the shooter to see the projectile trajectory and make aiming corrections as necessary.

Conventional tracer ammunition suffers from the disadvantage of being visible not only to the shooter but also to others, including potentially the target or enemies. This allows the enemy to identify the source of the gunfire and to return fire to the shooter. Conventional tracer ammunition also suffers from the disadvantage that as the powder pyrotechnic charge burns and leaves the cavity, the mass of the projectile decreases, and as a result the ammunition has erratic terminal ballistics which diminish targeting accuracy.

The powdered pyrotechnic materials conventionally used in tracer ammunition create environmental and hazardous material problems. They are dangerous and difficult to transport, handle and machine, which increases costs. The exothermic incendiary nature of the pyrotechnic materials makes them a fire hazard. Thus, for example, tracer ammunition has frequently resulted in fires on training ranges.

The patent literature includes inventions relating to tracer ammunition. For example, U.S. Pat. No. 8,402,896 by Hollerman et al. (University of Louisiana), "Hybrid-Luminescent Munition Projectiles", involves small arms tracers and their observability. U.S. Pat. No. 7,661,368 by Riess et al. (RUAG Ammotec), "Hard-Core Jacketed Bullet with Tracer Composition . . . ", discloses tracer bullets containing an illuminant composition. The patents differ from the present invention in the materials used, the mode of action, and other aspects.

There is still a need for an improved tracer ammunition that avoids the performance and safety disadvantages of conventional tracer ammunition, and that is suitable for military and recreational shooting.

Light-producing chemicals (aka, illuminants) are widely used in the pyrotechnics and defense industries to add bright effects to an application or event. For example, military bases often make use of "spotting" rounds when training gun crews. These rounds include a warhead containing an illuminant fill that produces a flash of light upon impact, thereby allowing the crew to track the proximity of its impact about the intended target and make any necessary aiming adjustments.

The ability to detect or "see" where the round is going or where it hits is critical to the training exercise. This requires the use of an illuminant that produces a luminous signature that is visible to the bare eye at downrange distances and that persists for a sufficiently long duration (e.g., ≥1 second). Current illuminants are not always ideal in the visibility or duration of their signature.

Additionally, current illuminants comprise environmentally hazardous chemicals, such as derivatives of chlorine (perchlorates). New environmental regulations are forthcoming which will require the elimination of such toxic and contaminating chemicals from use.

The patent literature includes inventions relating to military training rounds that produce a visible signature to mark their point of impact. For example, US Patent Application No. 2013/0199396 by Kroden et al. (Amtec), "Non-Dud Signature Training Cartridge and Projectile", discloses a military training cartridge projectile containing a pyrophoric powder that ignites and burns to provide a detectable indication of projectile impact with an object. U.S. Pat. No. 8,783,186 by Scanlon et al. (Alloy Surfaces), "Use of Pyrophoric Payload Material in Ammunition Training Rounds", discloses ammunition containing a pyrophoric metal powder that produces a bright flash when the ammunition hits a target. The patent documents differ from the present invention in the materials used, the resulting signature, and other aspects.

There is still a need for improved illuminants that are "green" so that they meet environmental regulations, particularly illuminants suitable for use in projectiles, and that maintain or exceed the illuminating properties of the chemicals they are replacing.

SUMMARY OF THE INVENTION

A self-glowing solid material comprises a man-made metal mixture containing at least one rare earth metal and an oxide of iron. The material is inducible by flame initiation to self-glow with yellow-to-red colors (577-to-700 nanometer wavelengths).

A stealth tracer ammunition comprises a projectile body having a tip and a base, and a solid pellet disposed in the base. The pellet may be made from the above-mentioned self-glowing solid material or another suitable material. The pellet becomes incandescent as a result of being heated when the ammunition is fired. The incandescent pellet emits a glow observable only from behind when the ammunition travels downrange after being fired.

An illuminant comprises a bimodal blend of a man-made metal mixture containing at least one rare earth metal and an oxide of iron. The bimodal blend is a blend of smaller-sized fragments and larger-sized pellets. The illuminant is capable of ignition and dispersion in response to ballistic energy to create illumination. For example, the ballistic energy may be energy applied to the illuminant during launch and/or upon impact with a target, and the illumination may be streamers or a flash.

An illumination device comprises a body having an interior cavity, the body configured to be launched as a projectile or configured to contain projectiles. For example, the illumination device may be a projectile or a shotgun shell for use as a path or target spotting round. An illuminant is disposed in the cavity of the body. The illuminant comprises a bimodal blend of a suitable illuminant material. For example, the illuminant material may comprise the above-mentioned man-made metal mixture or another man-made material containing at least one rare earth metal. The illuminant is capable of ignition and dispersion in response to ballistic energy to create illumination.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1A:
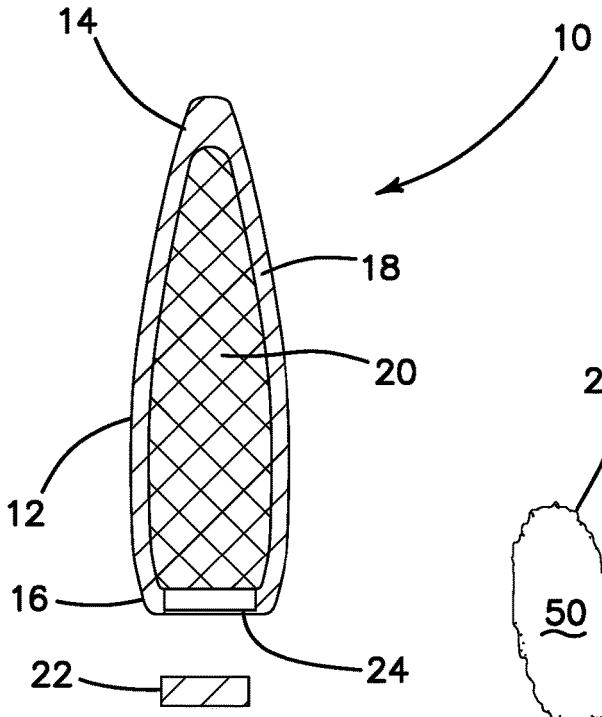
FIG. 1A is a side cross-sectional view of a stealth tracer bullet according to the invention, the bullet including a disc of a self-glowing solid material shaped as a right circular cylinder.

The present invention relates to novel self-glowing solid materials and their applications. In certain embodiments, the invention relates to novel tracer ammunition made with the materials.

The invention also relates to novel illuminants and their applications. In certain embodiments, the invention relates to novel illumination devices, such as projectiles or shotgun shells, containing the illuminants.

Various embodiments of the invention are described in more detail hereinbelow.

Self-Glowing Solid Materials

The present invention relates to man-made solid materials which, when exposed to flame with a sufficiently high temperature, "self-glow", not just from heating but also from reaction chemistry, and in particular from exothermicity. The materials provide the form, fit and function for a solution to problems with current tracer ammunition and other applications.

The self-glowing solid material comprises a man-made metal mixture containing at least one rare earth metal and an oxide of iron. The oxide of iron may be $Fe_2O_3$, $Fe_3O_4$, possibly other oxide(s), or a mixture of different oxides. The material is inducible by flame initiation to self-glow with yellow-to-red colors (577-to-700 nanometer wavelengths). In certain embodiments the self-glowing solid material is a misch metal containing an oxide of iron (in contrast to misch metals containing iron instead of iron oxide), and in a particular embodiment the misch metal is ferrocerium.

A "misch metal" (German for "mixed metal") is an alloy of rare earth metals. Ferrocerium is a misch metal containing the rare earth metals cerium, lanthanum, neodymium and praseodymium, plus an oxide of iron and/or magnesium oxide to increase hardness. For example, a commercial off-the-shelf ferrocerium may contain about 20% iron oxide, $Fe_2O_3$, about 39% cerium, about 18% lanthanum, about 14% neodymium and about 7% praseodymium.

Ferrocerium, in the form of a cylindrical pellet with a lacquer coating, is used as a spark-producing/fire-starting element in cigarette lighters. The Material Safety Data Sheet for ferrocerium in this form states that it is "not flammable" and "does not burn", and that ferrocerium pellets have been subjected to 927° C. (1700° F.) over a prolonged period without flammability. Thus, a typical person in this field would not see any reason to expose ferrocerium to a flame. That person would think nothing would happen because ferrocerium is not flammable, and would question why a material used to start a fire should instead be exposed to fire.

Surprisingly, the present inventors discovered in exploratory tests that there is a threshold flame temperature required to induce self-glowing by ferrocerium. The threshold temperature is believed to be about 1600° C. (2912° F.). This was demonstrated by exposing a ferrocerium pellet to a butane/air diffusion flame (1300° C.; 2372° F.) of a lighter, which did not result in self-glowing. However, self-glowing was induced when the pellet was exposed to a premixed butane/air flame (1900° C.; 3452° F.). It is believed that this temperature threshold is a reason why ferrocerium's ability to self-glow was not known before.

In the tests, a ferrocerium pellet having a diameter of 2.3 mm, a length of 4.7 mm, and a mass of 0.12 gram, was exposed (~1 second) to the tip of a premixed butane/air torch flame (peak temperature ~1900° C.; 3452° F.). After removing the flame, the pellet first glowed "red" then "yellow-hot" for about 5 seconds, then went dark/cold. The glow was defined by the physical shape and size of the pellet. Cooled, the pellet remained intact but friable, with no weight loss.

Further tests evaluated the effect of aspect ratio (L/D) of the pellets on the ease of induced glowing and maximum brightness, finding the lower the better for both. Tests were done on pellets having the following dimensions: D=2.3 mm/L=4.7 mm; D=4.5 mm/L=1.5, 2.0 or 2.5 mm; and D=8 mm/L=1.5, 2.0 or 2.5 mm. In certain embodiments, pellets are used having a relatively low aspect ratio to optimize the self-glowing; for example, an aspect ratio (L/D) of about 1 or less, more particularly about 0.9 or less, more particularly about 0.8 or less, or more particularly about 0.7 or less. The relatively low aspect ratio differentiates the pellets from rods which have a larger aspect ratio.

The inventors have discovered that the glow is self-sustaining after the flame is removed from the pellet. In certain embodiments, the self-glow persists for at least about 5 seconds, or at least about 10 seconds, and up to about 30 seconds after exposure to a flame with a temperature of about 1600° C. (2912° F.) or hotter. In certain embodiments, the self-glow begins after exposure to the flame has ended. It is believed that the self-glow is caused by an internal exothermic chemical reaction. The self-glow can be induced in an environment with no oxygen, and the pellet continues to glow in an environment without oxygen. The glow self-propagates throughout the pellet after flame exposure.

It is believed that the iron oxide content of the self-glowing solid material affects the reaction chemistry by which it can be made to self-glow. An increased iron oxide content is believed to increase the ease-of-initiation, brightness, and persistence of the self-glow. The more the onboard oxygen in the iron oxide, the less the reaction in the pellet needs to affix oxygen from the surrounding air, allowing the chemistry to initiate earlier and burn brighter longer. Also, an increased iron oxide content increases the hardness of the material, which is an advantage in many applications. In certain embodiments, the self-glowing solid material has an iron oxide content of at least about 20 wt %. In certain embodiments, the material is further iron-oxide enriched, having an iron oxide content of at least about 23 wt %, at least about 25 wt %, at least about 27 wt % or at least about 30 wt %.

In certain embodiments, the material has an increased iron oxide content, but retains proportionate levels of rare earth metals, allowing the hardness of configurations made of it to be increased such that they withstand harsher environments, such as acceleration forces from fired ammunition in gun barrels. For example, a misch metal according to the invention may have an iron oxide content of at least about 20 wt %, a cerium content of about 37 wt % to about 41 wt %, a lanthanum content of about 16 wt % to about 20 wt %, a neodymium content of about 12 wt % to about 16 wt %, and a praseodymium content of about 5 wt % to about 9 wt %.

The present invention relates generally to classes of man-made materials, misch and Auer metals, including but not limited to ferrocerium, which can be induced by flame-initiation to self-glow with yellow-to-red colors (577-to-700 nanometer wavelengths). In certain embodiments, the material is a metal mixture containing at least one rare earth metal and an oxide of iron.

The invention also relates to a material as described above wherein the self-glow is bright enough to be visible to the bare eye in daylight, and visible with the use of a thermal or infrared vision scope at night, at a distance of up to about 800 meters when used in small caliber ammunition.

The invention also relates to a material as described above having self-glowing with shape, size, duration, and visibility defined by the geometry and dimensions of the configuration in which the material is formed including, but not limited to, solid or hollowed-out right cylinders or discs.

The invention also relates to a material as described above having self-glowing that is initiated by a flame but whose visibility is not by virtue of an external flame plume but rather by virtue of incandescence.

The invention also relates to a material as described above wherein the material retains its original physical form (configuration) and does not decrease in mass during the duration of the self-glow.

The invention further relates to a material as described above wherein the material is configured as a cone-shaped or a pyramid-shaped disc having a tip and a base, which when the tip is directed toward an observer, the area of the self-glow increases as the material moves downrange, maintaining visibility as the distance between the material and the observer increases and the glow physically diminishes in diameter.

These characteristics and advantages will be described in more detail in relation to stealth tracer ammunition in the following section.

Stealth Tracer Ammunition

In another embodiment, the present invention relates to tracer ammunition including an incandescent material emitting a glow after firing that enables the shooter to follow the path of the ammunition.

The tracer ammunition of the invention overcomes the above-described disadvantages associated with current tracer ammunition. In flight, the ammunition emits glowing light like "car tail lights" observable by bare eyes for hundreds of meters but only from behind when flying downrange, providing stealth regarding the shooter location. Also, the ammunition glows without losing mass during flight, allowing it to match the terminal ballistics/targeting precision of corresponding non-tracer ball or slug ammunition.

Unlike current tracer ammunition, the light-producing material used in making the tracer ammunition is non-hazardous and safe for the environment. The material is not difficult, unsafe, or expensive to transport, handle or machine. The material is non-flammable so it does not present a fire hazard during manufacture or use of the ammunition.

The technology of the invention can be used with any of a number of different types of projectiles used as ammunition. This can include, for example, projectiles ranging from small projectiles used with pistols, rifles or shotguns, to larger projectiles used with mortars, cannons or howitzers. This can include small (0.22 in.-0.50 in.), medium (30-40 mm) or large (105-155 mm)-caliber military and civilian ammunition.

For example, a cartridge is a type of ammunition typically used with a rifle or pistol ("firearms"). As is well-known, a cartridge packages a bullet, a propellant and a primer within a case that fits precisely within the firing chamber of a firearm. When a shooter pulls the trigger, a firing pin strikes the primer and ignites it, and a jet of burning gas from the primer ignites the propellant. High-temperature gases from the burning propellant pressurize the case and propel the bullet through the barrel of the firearm and on a path toward a target.

Referring now to the drawings, there is illustrated in FIG. 1A a stealth tracer bullet 10 according to the invention having a body 12 including a tip 14 and a base 16. The base 16 of the bullet 10 will be seated in the open front end of a case (not shown) containing propellant and having an attached primer to produce a cartridge as described above.

There are a wide variety of overall bullet designs that allow bullets to achieve a broad range of functions: for example, jacketed bullets or monolithic bullets, and solid bullets or hollow-point bullets. The stealth tracer technology of the invention can be applicable to any of these designs.

In the embodiment shown in FIG. 1A, the bullet 10 includes a jacket 18 encasing a core 20. The jacket 18 is elongated and generally cylindrical. The jacket 18 tapers toward the tip 14 and has a reduced diameter ("boat tail") at the base 16. The jacket 18 can be made from copper, copper alloy, or any other suitable hard metal or material. The core 20 can be made from any suitable metal or other material, and is typically a relatively dense metal such as lead, copper, tungsten, iron, or alloys thereof.

The bullet 10 further includes a solid pellet 22 according to the invention disposed in its base 16. The pellet 22 becomes incandescent as a result of being heated when the ammunition is fired. In the above-described embodiment, the pellet 22 is heated by the burning propellant in the case of the ammunition, but the pellet may be heated by any other suitable heat source.

The pellet 22 can be made from any suitable material capable of producing the incandescent glow. In certain embodiments, the pellet 22 is made from a self-glowing solid material according to the invention as described above. Such a material enables the production of a pellet which is relatively dense, hard and lightweight. The mass of the pellet may be about 25-75% less than the mass of current tracer material. In certain embodiments, the pellet has a mass of from about 0.1 to about 75 grams, or more particularly from about 0.5 to about 3 grams. The pellet is hard enough to survive gun barrel launch and does not fragment.

The material used to make the solid pellet is machinable, non-hygroscopic, odor/gas-less, and solid-state. Machining of the material does not require specialized tools, techniques or added safety. The pellet can be manufactured by any suitable method. In certain embodiments, the solid material is shaped using slow-speed machining processes and techniques that allow high precision.

The incandescent pellet 22 emits a glow observable only from behind when the bullet 10 travels downrange after being fired. By "observable only from behind" is meant that the visibility angle is less than 180° (where the "visibility angle" is defined as an angle having a vertex on the bullet and centered on a line between the bullet and the shooter). In certain embodiments, the visibility angle is not less than about 90°.

The solid pellet 22 can be disposed in the base 16 of the bullet 10 in any suitable manner providing the above-mentioned stealth characteristic. In certain embodiments, the pellet 22 is embedded and/or recessed into the bottom of the base 16. In the embodiment shown, the jacket 18 of the bullet 10 extends downward a short distance past the bottom of the core 20, leaving a recessed area or cavity 24 inside the bottom of the jacket 18. The pellet 22 may be press fit or otherwise securely disposed inside the recessed area or cavity 24, a feature that can be incorporated into the bullet during manufacture by drilling into the core or enveloping it in copper casing. The pellet 22 stays attached to the bullet 10 during acceleration and flight of the bullet after firing.

The solid pellet 22 can have any suitable size. The pellet 22 is scalable so that it can be sized to fit into different sizes of ammunition. For example, it may be sized to fit directly into the base of a bullet having a caliber within a range of 0.22 inch to 0.50 inch. In certain embodiments, the pellet 22 has a diameter which is from about 85% to about 95% of the diameter of 0.22 inch-to-40 mm small-to-medium caliber ammunition, or from about 15% to about 25% of the diameter of 105 mm-to-155 mm large caliber ammunition.

Figure 2A:
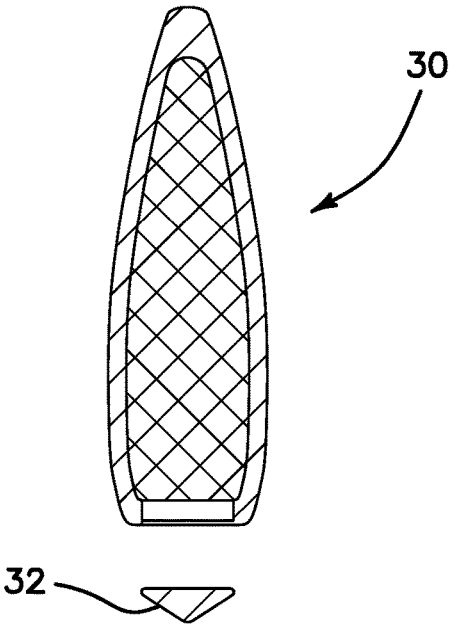
FIG. 2A is a side cross-sectional view of another embodiment of a stealth tracer bullet according to the invention, the bullet including a disc of a self-glowing solid material shaped as a cone having a tip directed outward from the rear of the bullet.
Figure 3:
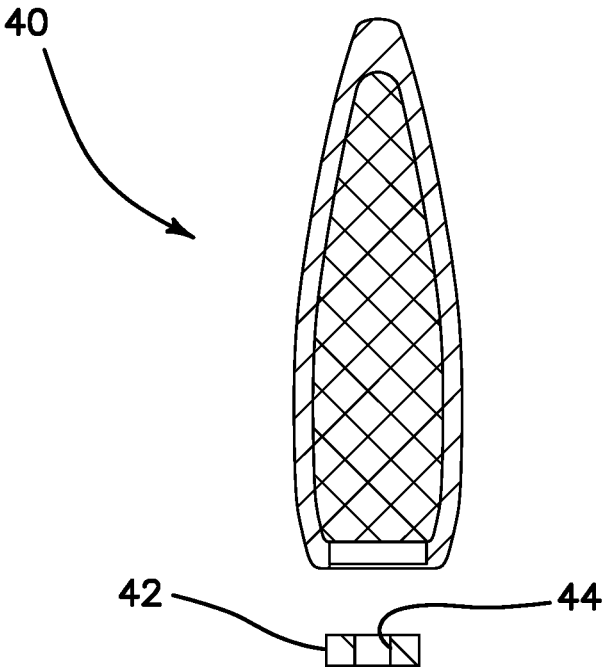
FIG. 3 is a side cross-sectional view of another embodiment of a stealth tracer bullet according to the invention, the bullet including a disc of a self-glowing solid material shaped as a center perforated right circular cylinder.

Additionally, the solid pellet 22 can have any suitable shape. In certain embodiments, the pellet 22 is generally disc-shaped and may be referred to as a disc. In certain embodiments, the disc is shaped as a cone, a pyramid, a right cylinder, or a center-perforated right cylinder. In the embodiment shown in FIG. 1A, the pellet 22 is a disc that is shaped as a right circular cylinder. In a second embodiment of a bullet 30, which is shown in FIG. 2A, the pellet 32 is a disc that is shaped as a cone having a tip 34 directed outward from the rear of the bullet. In a third embodiment of a bullet 40, which is shown in FIG. 3, the pellet 42 is a disc that is shaped as a perforated right circular cylinder. The disc has a circular hole 44 through its center.

The pellet 22 remains solid during the duration of the glow. This allows the shape and size of the glow to be defined by the geometry/dimensions of the pellet 22. In certain embodiments, the glow has a diameter of from about 5 to about 25 millimeters. In certain embodiments, the glow is visible to the bare eye of a shooter at a distance of up to about 800 meters for small caliber ammunition, up to about 1200 meters for medium caliber ammunition, and up to about 4000 meters for large caliber ammunition.

Figure 1B:
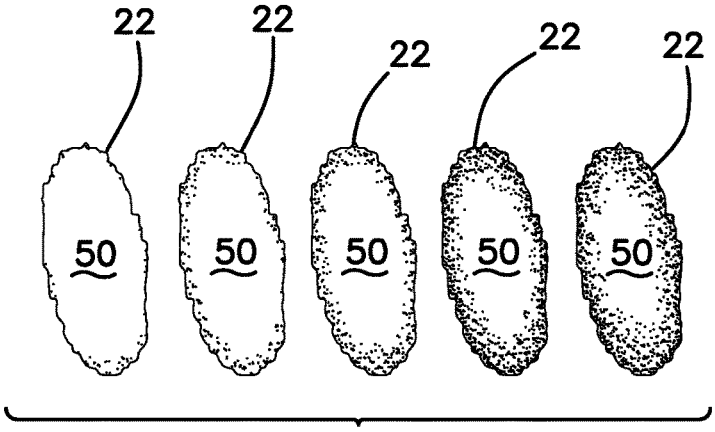
FIG. 1B is a schematic representation showing a decreasing glow area of the disc of FIG. 1A with increasing downrange distance of the bullet.
Figure 2B:
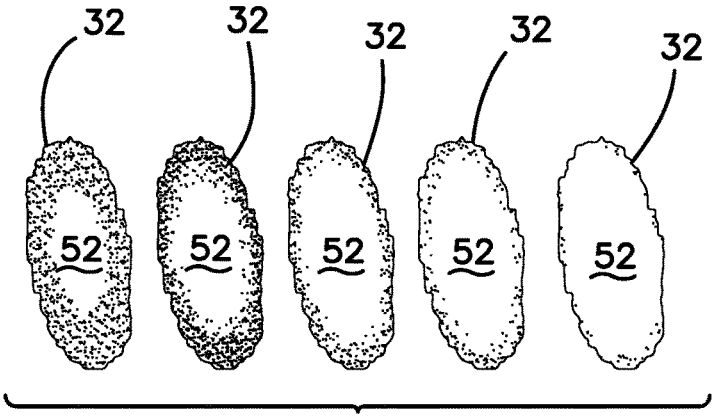
FIG. 2B is a schematic representation showing an increasing glow area of the disc of FIG. 2A with increasing downrange distance of the bullet.

FIGS. 1B and 2B illustrate one way in which the shape and size of the glow can be defined by the geometry/dimensions of the pellet. In each figure, the shapes from left to right show the pellet as it appears with increasing downrange distance of the bullet, as viewed from behind the bullet at a slight angle offline. The light area in the center of the pellet is the area of the glow. In FIG. 1B, the pellet 22 having the shape of a right cylinder results in a glow area 50 that decreases with increasing downrange distance of the bullet. In FIG. 2B, the pellet 32 having the shape of a cone with a rearward directed tip results in a glow area 52 that increases with increasing downrange distance of the bullet. The increasing glow area 52 maintains visibility as the distance from the shooter to the bullet increases.

The glow from the pellet persists after the bullet breaks contact with the burning propellant in the gun barrel. In certain embodiments, the glow persists for a time from about 1 second to about 30 seconds after exposure to the burning propellant. In certain embodiments, the glow is visible after firing the ammunition for a time of from about 1 second to about 10 seconds. The duration of the glow is not limited and can be extended to various weapons' ranges.

The stealth tracer technology of the invention can have a number of market and product applications. The market for this tracer ammunition is global, focusing on Joint Arms Services (Army, Navy, Air Force, Marines and Special Operations) and law enforcement agencies. Another market is tracer ammunition for recreational civilian shooters worldwide.

Illuminants

In another embodiment, the present invention relates to an illuminant, and a process for making it, capable of satisfying performance requirements as well as meeting environmental requirements.

The illuminant can be made from any of the self-glowing solid materials described above. In certain embodiments, the illuminant is made from ferrocerium. For purposes of simplification, the following description will refer to ferrocerium but it is understood that it can be applicable to any of the materials.

A non-obvious combination of an alternative ignition source and a special particle size blending process have been found to create brilliant illumination in the form of streamers and/or flashes from a material reportedly incapable of doing so: ferrocerium, aka manmade flint. As mentioned above, the Material Data Safety Sheet of ferrocerium states that cylindrical pellets of it are "not flammable" and do not burn. Discovered unexpectedly were that not only could a bright light be ignited via ballistic launch or impact but also that its occurrence, brightness, duration, and size relied on the use of a blend having a bimodal size distribution.

Figure 4:
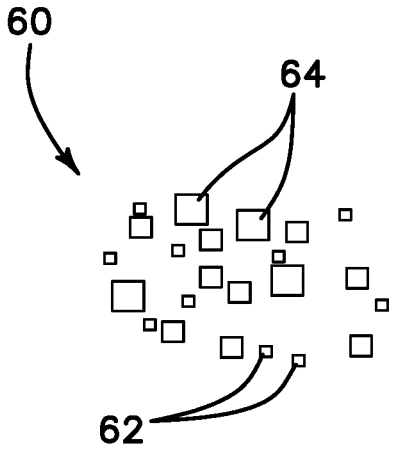
FIG. 4 is a side cross-sectional view of an illuminant according to the invention comprising a bimodal blend of ferrocerium.

Specifically, the bimodal blend comprises "reduced size" ferrocerium fragments of a deliberately smaller size (first mode of bimodal distribution) and "pristine" ferrocerium pellets not subjected to size reduction (second mode). FIG. 4 shows an illuminant 60 according to the invention comprising a bimodal blend of fragments 62 and pellets 64.

Also non-obvious was the discovery that gun launch or ballistic impact, not abrasive friction, was capable of ferrocerium ignition and it did not require a second material. Off-the-shelf ferrocerium pellets are not ignition sensitive to impact. In "flint strikers", such as found in cigarette lighters, the ferrocerium pellet must be rapidly ground against an abrasive steel striker to obtain incandescent sparks to ignite the lighter fluid. Surprisingly, the present inventors achieved ignition upon launch or impact in low-velocity (≤1,000 feet/second) gunfire of the bimodal ferrocerium blends inside plastic shells. This ignition was achieved even though the gun barrel or shell did not contain any abrasive striker material and the only source of ignition energy was propellant burning or low-velocity flight toward or impact against a soft (wood) target.

It was discovered that upon launch, impact and dispersion of the bimodal blend of ferrocerium, reduced size fragments promptly ignite and rapidly burn, which, in turn, surprisingly ignite the larger pristine pellets. The resulting long-lived illumination has a diameter defined by the dispersion path lengths of the individual ferrocerium particles. The reduced size fragments scatter farther from the point of impact than the whole pellets because of their lower aerodynamic drag forces. Because of this distributed dispersion of small and large incandescent ferrocerium particles, brilliant streamers or flashes of intensified bright light result.

In contrast, upon launch or after impact a dispersed cloud comprising only reduced size ferrocerium fragments results in prompt ignition but a relatively brief, diffuse (low intensity) illumination. A payload comprising only pristine ferrocerium pellets results in a very low probability of ignition; if it occurs, only a few very dull streaks of glowing pellets and not a bright flash of light are observable.

As described above, the bimodal blend of ferrocerium or other self-glowing solid material comprises a blend of smaller-sized fragments and larger-sized pellets. The fragments and pellets can have any suitable size and shape. For example, the fragments may be irregularly-shaped fine-sized fragments prepared by comminution as described below. The pellets may be commercially available cylindrical pellets. An example is pellets shaped as a right circular cylinder and having a length of 7 millimeters and a diameter of 3.5 millimeters.

In certain embodiments, the fragments have a Feret diameter of from about 0.7 millimeter to about 1.8 millimeters, more particularly from about 0.8 millimeter to about 1.7 millimeters, or more particularly about 1.25 millimeters.

In certain embodiments, the pellets have a Feret diameter of from about 2 millimeters to about 10 millimeters, more particularly from about 4 millimeters to about 6 millimeters, or more particularly about 5 millimeters.

In certain embodiments, the pellets have a Feret diameter which is from about 2× to about 12× the Feret diameter of the fragments, more particularly from about 4× to about 10× the diameter, or more particularly about 4× the diameter.

The Feret diameter of an object, also known as the caliper diameter, is the distance between two parallel tangents touching opposite sides of the object. The Feret diameter is a standard measurement of particle size, but it can also be applied to larger objects. The diameter of an asymmetric object varies depending on its orientation, so it is common to determine maximum, minimum and mean Feret diameters. These diameters can be obtained from an image of the object using image analysis software. As used herein, the Feret diameter is defined as the mean Feret diameter.

The bimodal blend can contain any suitable amounts of fragments and pellets. In certain embodiments, the bimodal blend comprises, by mass percent, from about 60% to about 90% fragments and from about 10% to about 40% pellets, more particularly from about 70% to about 85% fragments and from about 30% to about 15% pellets, or more particularly about 81% fragments and about 19% pellets.

In certain embodiments, the bimodal blend comprises a mass ratio of fragments to pellets of from about 2:1 to about 8:1, more particularly from about 3:1 to about 5:1, or more particularly about 4:1.

The total mass of the fragments and pellets in the bimodal blend may vary depending on the particular application in which the illuminant is used. In certain embodiments, the bimodal blend has a total mass of from about 10 to about 100 grams, more particularly from about 20 to about 50 grams, or more particularly about 25 grams. In an example, the bimodal blend comprises about 22 grams of fragments and about 5 grams of pellets.

The bimodal blend of ferrocerium or other self-glowing solid material can be produced by any suitable method. In certain embodiments, the fragments are produced by grinding ferrocerium pellets into finer-sized fragments. This grinding can be accomplished using comminution, or particle-against-particle grinding, to process several very hard ferrocerium pellets into sizes smaller than achievable by smashing one pellet at a time. This sizing method produces asymmetric ferrocerium fragments of finer or "reduced" sizes than off-the-shelf or "pristine" pellets. These reduced size fragments mixed with pristine pellets form a bimodal blend of widely different sizes.

The illuminant of the invention can be used in many different market and product applications, and in particular any kind of application in which it is desired to produce illumination. This may include some applications in which the illuminant is contained in a projectile, some applications in which the illuminant itself is a projectile (such as shotgun shells), and other applications not relating to projectiles.

Devices Containing Illuminant

The invention also relates to devices containing illuminant which are capable of creating brilliant illumination. The illumination may comprise light in the form of streamers, flashes, or other forms of visible light.

The illuminant used in an illumination device of the invention comprises a bimodal blend of a suitable illuminant material. For example, it may comprise the above-described man-made metal mixture, or another man-made material containing at least one rare earth metal, or any other suitable material.

The illumination device includes a body having an interior cavity, and the illuminant is disposed in the cavity. The body of the device is configured to be launched as a projectile or configured to contain projectiles. For example, the illumination device may be a projectile such as a path or target spotting round which is launched and creates streamers in-flight and/or a flash of light upon impact with a target. Alternatively, the illumination device may be a shotgun shell including a cartridge case which contains the pellets and fragments of the illuminant material as projectiles.

The illuminant is capable of ignition and dispersion in response to ballistic energy to create the illumination. By "ballistic energy" is meant any energy applied to the illuminant when the illuminant is contained in a projectile or the illuminant itself is a projectile. This may include energy applied at a time from when the gun is fired to before the projectile exits the gun barrel (internal ballistics), energy applied after the projectile exits the gun barrel and before it hits a target (external ballistics), and/or energy applied when a projectile impacts a target (terminal ballistics).

For example, when the device is a shotgun shell according to the invention, the illuminant bursts on firing due to forces realized during ballistic acceleration. Material that is released ignites and effectively illuminates streamers of shot-lines about the target in-flight, for example, a clay pigeon.

Figure 5:
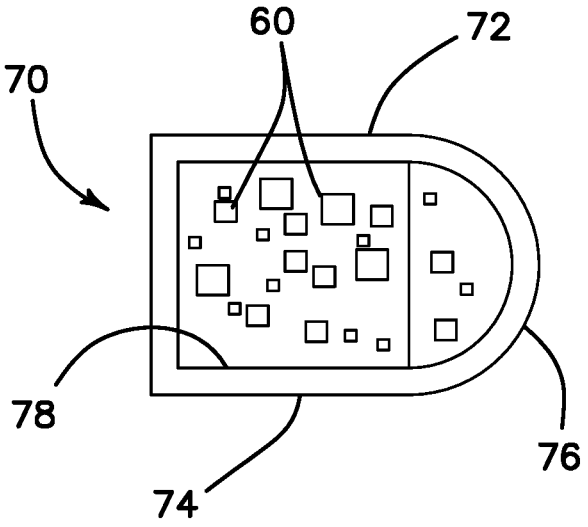
FIG. 5 is a cross-sectional view of an illumination device according to the invention which is a projectile having a cavity filled with the illuminant.

FIG. 5 shows an example of one embodiment of a projectile 70 according to the invention. There are a wide variety of overall designs for projectiles and the illuminant of the invention can be applicable to any of these designs. The projectile 70 includes a projectile body 72 designed to withstand energy applied when it is fired and designed to disintegrate when the projectile 70 is subjected to ballistic energy, such as an external energy applied during launch or a terminal energy applied upon target impact.

In some embodiments, the projectile 70 may be seated in the front end of a cartridge case (not shown) containing propellant for firing the projectile. In other embodiments, the projectile 70 may be fired using bagged propellant (not shown) in an artillery gun instead of a cartridge case. In other embodiments, the projectile 70 may be fired using "caseless" ammunition, in which the case is comprised not of a metal, plastic or composite, but of an energetic material of suitable mechanical integrity to withstand pressures and forces experienced during ignition and launch, yet which burns during launch. Any suitable means may be used for firing the projectile 70.

The projectile body 72 can have any suitable construction and it can be made from any suitable material(s). The body 72 can be configured in multiple calibers. In the embodiment shown in FIG. 5, the projectile body 72 comprises two pieces: a container 74 and an ogive 76. Alternatively, the body could have a one-piece construction.

The container 74 shown is cylindrical with a closed rear end and an open front end. The container 74 may be made from a relatively sturdy material.

The ogive 76 is an arch-shaped cap at the front of the projectile body 72. The ogive 76 is fastened to the front end of the container 74 by any suitable means, such as threads, snap fit, interference fit or adhesive.

The ogive 76 is made from a frangible material such as frangible plastic, ceramic, or brittle metal, so that it breaks up when the projectile 70 is launched or impacts a target. Alternatively, the entire projectile body 72 could be made from a frangible material.

As shown in FIG. 5, the container 74 and the ogive 76 are hollow and have an interior cavity 78. An illuminant 60 according to the invention is disposed in the cavity 78. In the embodiment shown, the illuminant 60 substantially fills the cavity 78. As described above, the illuminant 60 comprises a bimodal blend of ferrocerium or similar material.

The projectile body 72 disintegrates when the projectile 70 is launched or impacts a target. The illuminant 60 disperses when the projectile body 72 disintegrates and creates streamers or flashes with brilliant illumination.

Figure 6:
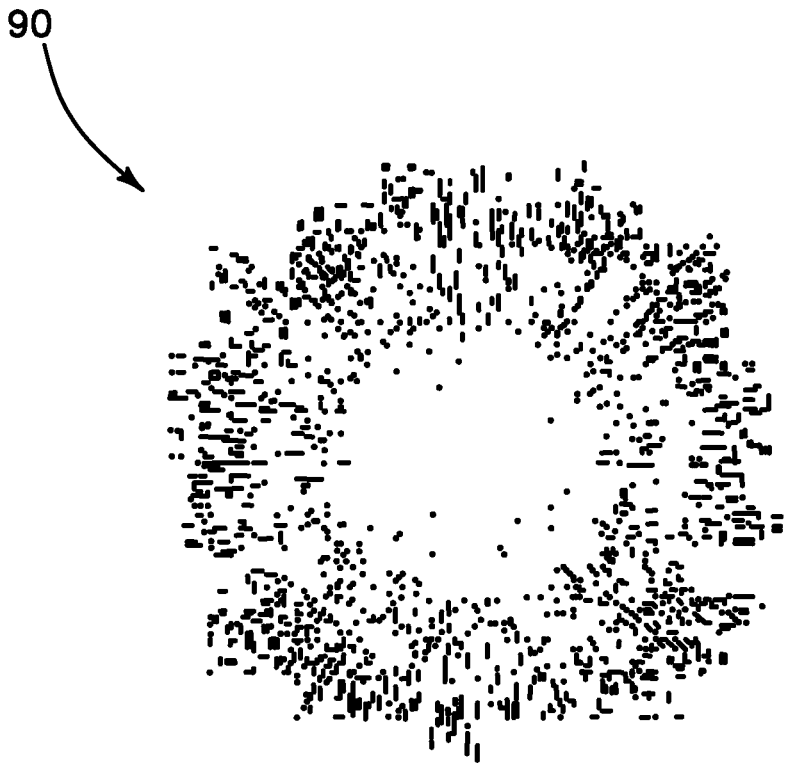
FIG. 6 is a cross-sectional view of illumination in the form of a streamer or a flash of light which may be created by the illumination device of the invention.

FIG. 6 shows an example of outbound streamers or a flash 90 as seen in two dimensions by the shooter that may be created by the projectile 70 in-flight or impacting a target. The characteristics of the streamers and flash 90 may be tailored for a specific use by modifying the illuminant 60 and/or the projectile body 72.

In certain embodiments, the illumination has a brightness that is visible to the bare eye in daylight at a distance of up to about 4000 meters.

In certain embodiments, the illumination has a duration of from about 0.1 second to about 5 seconds, or more particularly from about 1 second to about 2 seconds.

In certain embodiments, the illumination has a Feret diameter of from about 0.1 meter to about 3 meters, or more particularly from about 0.5 meter to about 1 meter.

The illumination devices of the invention can have many applications, including those related to military, law enforcement and civilian use.

The principle and mode of operation of this invention have been explained and illustrated in its preferred embodiments. However, it must be understood that this invention may be practiced otherwise than as specifically explained and illustrated without departing from its spirit or scope.

The invention claimed is:

1. A stealth tracer ammunition comprising: a projectile body having a tip and a base; and a solid pellet disposed in the base of the projectile body;

the pellet becoming incandescent as a result of being heated when the ammunition is fired;

the incandescent pellet emitting a glow observable only from behind when the ammunition travels downrange after being fired;

wherein the pellet has the shape of a cone with a rearward directed tip.

2. The stealth tracer ammunition of claim 1 wherein the pellet comprises a man-made metal mixture containing at least one rare earth metal and an oxide of iron.

3. The stealth tracer ammunition of claim 1 further comprising a metal, polymer, composite, or energetic case having an open end in which the projectile body is seated, the case containing propellant which burns to generate propulsion of the projectile body when the ammunition is fired, the burning propellant heating the pellet to cause incandescence of the pellet.

4. The stealth tracer ammunition of claim 1 consisting essentially of a projectile body having a tip and a base; a metal, polymer, composite, or energetic case having an open end in which the projectile body is seated, the case containing propellant which burns to generate propulsion of the projectile body when the ammunition is fired; and a solid pellet disposed in the base of the projectile body;

the pellet becoming incandescent as a result of being heated when the ammunition is fired; the incandescent pellet emitting a glow observable only from behind when the ammunition travels downrange after being fired.

5. A stealth tracer ammunition comprising: a projectile body having a tip and a base; and a solid pellet disposed in the base of the projectile body;

wherein the pellet comprises a man-made metal mixture containing at least one rare earth metal and an oxide of iron;

the pellet becoming incandescent within about one second as a result of being heated when the ammunition is fired;

the incandescent pellet emitting a glow observable only from behind when the ammunition travels downrange after being fired.

6. The stealth tracer ammunition of claim 5 wherein the pellet retains its original conformation during the duration of the glow.

7. The stealth tracer ammunition of claim 5 wherein the glow is visible to a bare eye of a shooter at a distance of up to about 800 meters when the stealth tracer ammunition is a small caliber ammunition, up to about 1200 meters when the stealth tracer ammunition is a medium caliber ammunition, and up to about 4000 meters when the stealth tracer ammunition is a large caliber ammunition.

8. The stealth tracer ammunition of claim 5 wherein the glow has a duration of 1 to 10 seconds.

9. The stealth tracer ammunition of claim 1 further comprising a metal, polymer, composite, or energetic case having an open end in which the projectile body is seated, the case containing propellant which burns to generate propulsion of the projectile body when the ammunition is fired, the burning propellant heating the pellet to cause incandescence of the pellet.

10. The stealth tracer ammunition of claim 9 wherein the glow persists after the propellant stops burning.

* * * * *